United States Patent [19]

Weyand et al.

[11] 4,249,720

[45] Feb. 10, 1981

[54] APPARATUS FOR THE CONTINUOUS TREATMENT OF METAL OBJECTS

[75] Inventors: Karl Weyand; Günter Stock, both of St. Ingbert, Fed. Rep. of Germany

[73] Assignee: Trefilarbed S.A., Luxembourg, Luxembourg

[21] Appl. No.: 55,190

[22] Filed: Jul. 2, 1979

[30] Foreign Application Priority Data

Jul. 3, 1978 [LU] Luxembourg ..... 79911

[51] Int. Cl.[3] ..... C21D 9/62; C21D 1/40; C21D 1/48; C21D 9/52

[52] U.S. Cl. ..... 266/104; 148/154; 148/156; 266/107; 266/112

[58] Field of Search ..... 266/102, 104, 107, 112; 148/15, 154, 156, 157, 144, 12.4, 12.1

[56] References Cited

U.S. PATENT DOCUMENTS

| | | | |
|---|---|---|---|
| 2,300,329 | 10/1942 | Wood et al. | 266/104 |
| 2,463,412 | 3/1949 | Nachtman | 266/104 |
| 3,163,566 | 12/1964 | Jenkins et al. | 266/112 |
| 3,277,270 | 10/1966 | Trautman | 266/107 |
| 3,353,806 | 11/1967 | Lichte | 266/107 |
| 3,858,859 | 1/1975 | Baguet | 266/107 |
| 4,168,995 | 9/1979 | Erdödi et al. | 148/154 |

FOREIGN PATENT DOCUMENTS

| | | | |
|---|---|---|---|
| 948545 | 1/1949 | France | 266/107 |
| 22043 | of 1895 | United Kingdom | 148/154 |
| 1121548 | 7/1968 | United Kingdom | 148/156 |

*Primary Examiner*—L. Dewayne Rutledge
*Assistant Examiner*—Peter K. Skiff
*Attorney, Agent, or Firm*—Karl F. Ross

[57] ABSTRACT

An apparatus for the continuous heat treatment of elongated metal objects, especially wire, by contacting the same with molten metal, usually lead, whereby a preheating tray containing the molten metal is followed by a quenching tray with a second bath through which the metal is passed in succession. The preheating tray containing the first metal bath is electrically insulated and partly immersed in the quenching bath while electric current is applied across the baths to resistively heat the metal between them.

5 Claims, 4 Drawing Figures

APPARATUS FOR THE CONTINUOUS TREATMENT OF METAL OBJECTS

FIELD OF THE INVENTION

The present invention relates to an apparatus for the continuous heat treatment of metal objects and articles, especially continuous or elongated metal bodies such as wire, steel strip and the like.

BACKGROUND OF THE INVENTION

A common practice in the production of wire is the heat treatment thereof to effect patenting in which the lattice structure of the metal of the wire is converted by austenitizing it and then transforming it as completely as possible to a sorbite (granular martensite) lattice structure.

Since 1930, at least, efforts have been made to use electrical heating techniques to effect the heat treatment or patenting of wire so as to overcome the disadvantages of the classical methods whereby the wire was brought to patenting temperatures by radiation in appropriate heating chambers and over long residence times, especially when the wire was relatively thick. The electrical techniques were intended to utilize the resistance heating effect or the ohmic heat generated directly within the wire by the passage of the electric current therethrough.

The apparatus developed for this purpose generally comprises a preheating bath, usually of molten lead, in which the wire was heated to a temperature of 450° C. to 550° C. by drawing it continuously through the bath.

A similar bath served as a quenching bath and both baths were connected with a transformer so that the wire in the stretch between the baths was heated by the resistance heating or ohmic heat.

By appropriate selection of the transformer parameters and the length of the wire over the free stretch, i.e. the socalled annealing stretch between the point and the wire emerged from the first bath to the point at which the wire was immersed in the second bath, the wire could be brought in a relatively short time to the austenitizing temperatures of around 1,000° C. which were required, this temperature being well above the $Ac_3$ point. By passage then through the quenching bath, the wire was cooled to about 500° C. and held at this temperature for about twenty seconds to allow the development of the desired fine grained sorbite (granular martensite) lattice structure.

While significant amounts of energy were required to heat the preheating bath, significant amounts of thermal energy must be dissipated from the quenching bath so that the overall energy consumption of the system was poor and the operation was highly expensive. In fact, the system required considerably more energy to operate the metal bath than was consumed in the heating of the metal wire between the metal baths.

Efforts have been made to reduce the energy consumption of such systems by, for example, heating the wire in at least one electrical induction furnace to the austenitizing temperature and then passing the wire through a single metal bath in which the sorbite lattice structure could be formed. In this case the metal bath served in part as a quenching bath but also as the preheating bath.

The advantage of this system is that it does bring about a reduction in the overall energy consumption, although difficulties have been encountered with it. For example, wire with a diameter of 3 mm or more cannot be effectively processed in the induction furnaces when a continuous production of the wire is required by providing the patenting system in the wire production line. In other words, with wires of a diameter above 3 mm, the heating of the wire in an induction furnace does not take place sufficiently rapidly to allow the system to be placed in line in the wire production plant.

OBJECTS OF THE INVENTION

It is the principal object of the present invention to provide an improved apparatus for heat treatment of elongated metal objects, especially wire.

Another object of the invention is to provide an apparatus for the heat treatment of steel wire, strip and like elongated material which can process the material at an especially high rate consistent with the rate of production of the material in the manufacturing line therefor.

Yet another object of this invention is to provide an improved apparatus for the patenting of steel wire which avoids the disadvantages of the prior-art systems mentioned previously.

SUMMARY OF THE INVENTION

These objects and others which will become apparent hereinafter are attained, in accordance with the present invention, in an apparatus for the purposes described, namely for the heat treatment continuously of an elongated metal article, especially for the patenting of steel while indicating heat treatment of steel strip, which comprises two vessels or ladles of tray configuration, i.e. upwardly open, containing a preheating bath of molten metal and a quenching bath of molten metal, these vessels being connected to the terminals of the secondary winding of a transformer, and means for conducting the elongated articles in a path first through the preheating bath, next over a stretch wherein the metal is outside both baths, and then in a stretch through the quenching bath of sufficient length to enable the sorbitizing of the wire.

According to the invention, the preheating vessel is at least partially immersed in the bath of the quenching vessel and the wall of the preheating vessel in contact with the molten metal of the quenching vessel is electrically insulating but has the highest possible thermal conductivity.

According to a feature of the invention, the quenching vessel is provided with a pumping unit for circulating the molten metal therein around the aforementioned wall. In general the volume of the molten metal in the quenching vessel should be at least twice the volume of the molten metal in the preheating bath and when this volume ratio exceeds more than 2, the pumping unit is especially important.

The pumping unit can be any conventional system which can be used for the circulation of molten metal, continuous circulation of the molten metal in the quenching vessel serving on the one hand to transport thermal energy directly to the walls of the preheating bath and, on the other hand, to avoid overheating in the region in which the wire enters the quenching bath.

The heat delivered to the wire for the annealing and austenitizing stage is practically transferred completely to the quenching bath during the subsequent austenitizing stage and is thus recycled from the connecting bath to the preheating bath through the wall of the latter in the manner described.

According to another feature of the invention, the quenching bath can be provided with a combined heat-and-cooling unit which may be electrically or fluid operated and which provides the necessary temperature in the baths during startup of the installation and can remove any excess heat during the operation.

Experiments have shown that the apparatus of the present invention can use as heat input solely the electrical energy required for the austenitizing heating of the wire while nevertheless maintaining the preheating baths at a sufficiently high temperature as not to require any additional energy supply during patenting of the wire. The quenching bath maintains a homogeneous temperature of 500° C. to 550° C., usually without any additional heat input from an external source. By comparison to conventional resistance type of heating patenting installations an energy saving of up to 50% can be realized.

When the quenching bath has more than twice the volume of the preheating bath, it can be provided in an elongated vessel which can be divided by a partition into two portions or two separate quenching baths can be used, only one of which contains the preheating vessel and is connected with the other by a flow passage.

The wall of the first or preheating vessel is composed preferably of steel with the insulation layer being a heat conductive electrically insulating material bonded thereto or cladded therein. It is also within the purview of this invention to employ a sandwich construction in which the insulation layer is bonded between two steel layers. The insulation layer can be a ceramic material such as aluminum oxide or magnesium oxide.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1B:
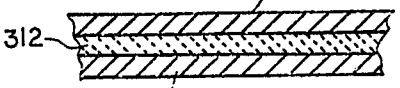
FIGS. 1A and 1B are detail views representing cross sections through the wall of the preheating vessel.
Figure 1A:
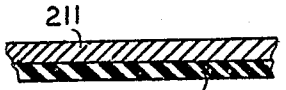
Figure 1:
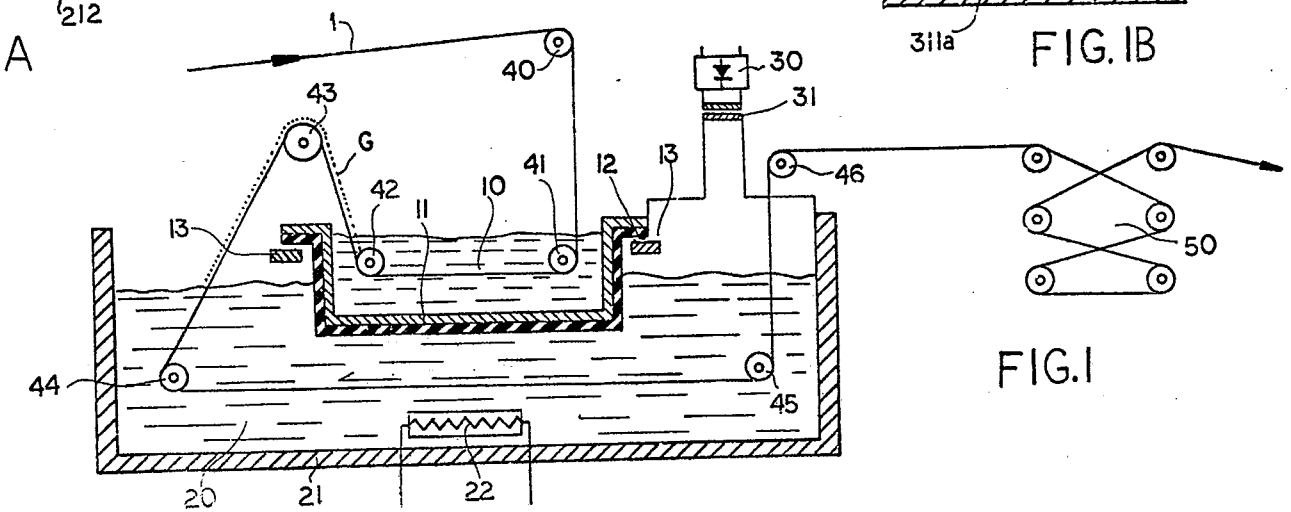
FIG. 1 is a diagrammatic cross-sectional view illustrating one embodiment of an apparatus according to the present invention.

In FIG. 1 we have shown an apparatus for the patenting of steel wire which comprises a preheating bath 10 of molten metal, preferably lead, retained in a first vessel 11 whose wall structure will become more readily apparent hereinafter. The outer layer 12 of this vessel is an electrically insulating material having a high coefficient of thermal conductivity, e.g. a ceramic, while the inner wall of the vessel 11 is composed of steel. The vessel rests upon insulating supports 13 and is at least partially immersed in the quenching bath 20 of molten lead which is electrically insulated from the bath 10 by the layer 12.

The electrically conductive walls of the preheating vessel 11 and quenching vessel 21 are connected to the secondary-winding terminals of a transformer 31 supplied at the primary winding with a pulsed-current source 30.

Because of the insulation 12 lining the vessel 11, the metal baths 10 and 20 are in electrical connection only over the stretch of the wire G between the point at which the wire emerges from the bath 10 and the point at which the wire enters the bath 20, this stretch being indicated by dots.

The apparatus thus includes a plurality of rolers 40 and 41 leading the wire into the preheating bath 10, rollers 41, 42 conducting the wire beneath the surface of the bath 10, rollers 42, 43 leading the wire out of the bath, rollers 43, 44 leading the wire through the bath 20, rollers 45, 46 leading the wire out of the bath 20 and rollers 50 forming an air cooling bath for the wire downstream of the patenting apparatus.

Within the stretch G, the wire is heated rapidly by resistance heating to a temperature of about 1,000° C.

Within the quenching bath 20, there is provided a combined heat-and-cooling unit 22 to bring the baths to the starting temperature and remove surplus heat during operation.

The wire, after transversing the bath and being heated in the manner described, is sorbitized (converted to granular martensite) and then cooled to room temperature in the air cooling stretch 50.

Figure 2:
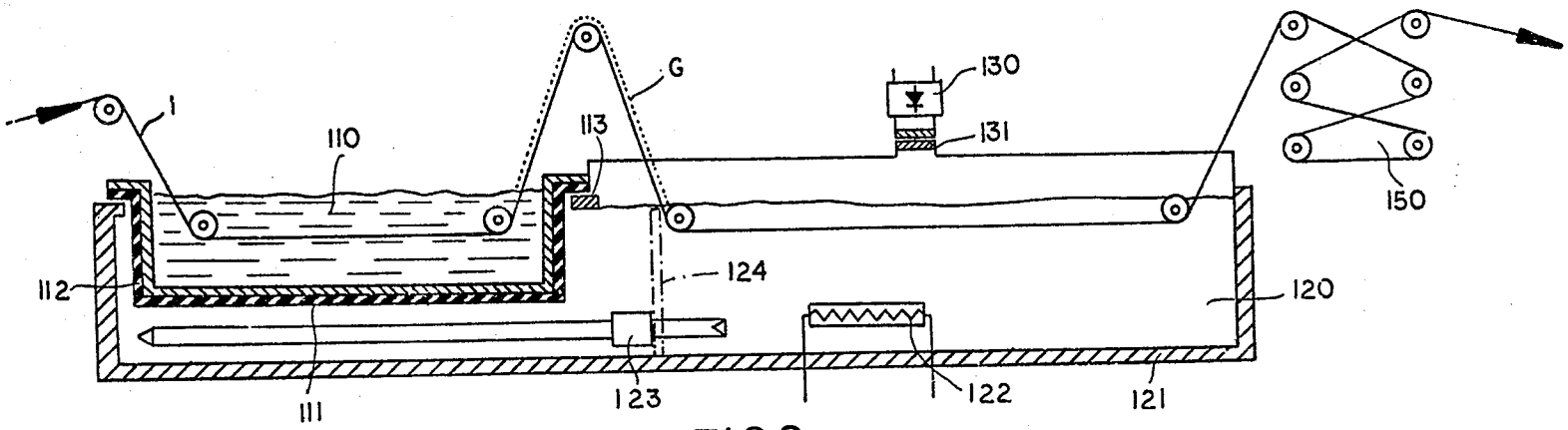
FIG. 2 is a cross section diagrammatically illustrating another embodiment of the instant invention.

Corresponding elements in the embodiment of FIG. 2 have been given corresponding reference numerals in the hundreds series. Here, however, it is important to note that the elongated bath 120 may be partitioned, e.g. at 124, with the liquid overflowing this partition and being circulated by a pumping unit 123 which carries thermal energy directly from the region at which it is transferred to the bath 120, into the region of the walls 111 of the bath 110. The wire is displaced over a corresponding roller arrangement in the direction opposite that in which the molten metal is pumped. The system of FIG. 2 thus otherwise operates in the same manner as that of FIG. 1.

In FIG. 1A we have shown in greater detail that the inner wall 211 of the preheating vessel can be externally clad with bonded ceramic 212 which acts as the electrical insulation having a high coefficient of thermal conductivity.

In the embodiment of IFG. 1B, the inner wall 311 forms a sandwich with an outer wall 311*a*, the ceramic insulating layer 312 being disposed between these walls.

We claim:

1. An apparatus for the heat treatment of a continuous metal element, comprising:

an upwardly open first vessel receiving a first molten metal bath for preheating said element, said vessel being formed with an electrically insulating thermally conductive wall;

a second upwardly open vessel receiving a second bath of molten metal for the quenching of said element, said first vessel being immersed in the said second vessel with said wall in direct heat conducting relationship between said baths;

means for conducting said element through said first bath along a resistance heating stretch, and then through said bath in said second vessel and thereafter out of said bath in said second vessel whereby said element is preheated in the bath in said first vessel and is quenched in the bath of said second vessel; and an electric current supply connected across the baths in said vessels whereby an electric current is passed through said element over said stretch to heat said element.

2. The apparatus defined in claim 1, further comprising pump means for circulating the molten metal of the bath in said second vessel around said wall.

3. The apparatus defined in claim 2 wherein said pump means is a pumping unit disposed in said second vessel.

4. The apparatus defined in claim 1, claim 2, or claim 3, further comprising a combined heating-and-cooling unit in said second vessel for raising said bath to a predetermined operating temperature and thereafter abstracting excess heat from the bath in said second vessel.

5. The apparatus defined in claim 1, claim 2, or claim 3 wherein said second vessel is elongated and said first vessel is immersed in the bath in said second vessel at one end thereof.

* * * * *